US010500113B2

(12) United States Patent
Torgersson

(10) Patent No.: US 10,500,113 B2
(45) Date of Patent: Dec. 10, 2019

(54) LOCKING MECHANISM OF AN ARMREST ASSEMBLY FOR A WHEELCHAIR AND A WHEELCHAIR COMPRISING THE SAME

(71) Applicant: Permobil AB, Timrå (SE)

(72) Inventor: Par Torgersson, Matfors (SE)

(73) Assignee: PERMOBIL AB (SE)

( * ) Notice: Subject to any disclaimer, the term of this patent is extended or adjusted under 35 U.S.C. 154(b) by 37 days.

(21) Appl. No.: 15/982,084

(22) Filed: May 17, 2018

(65) Prior Publication Data

US 2018/0344549 A1 Dec. 6, 2018

(30) Foreign Application Priority Data

Jun. 1, 2017 (EP) ..... 17173983

(51) Int. Cl.
*A61G 5/12* (2006.01)
*A61G 5/10* (2006.01)

(52) U.S. Cl.
CPC ..... *A61G 5/125* (2016.11); *A61G 5/1043* (2013.01); *A61G 5/1005* (2013.01)

(58) Field of Classification Search
CPC .... A61G 5/125; A61G 5/1043; A61G 5/1005; A47C 7/54; A47C 7/541; A47C 7/543; A47C 7/546; B60N 2/753; B60N 2/763
See application file for complete search history.

(56) References Cited

U.S. PATENT DOCUMENTS 3,993,350 A * 11/1976 McFarlane ..... A47C 7/543 297/411.38
5,104,191 A * 4/1992 Tame ..... B60N 2/753 297/411.32
5,409,297 A * 4/1995 De Filippo ..... B60N 2/757 297/411.32

(Continued)

FOREIGN PATENT DOCUMENTS

AU 2013101285 A4 10/2013
DE 202006002357 U1 4/2006
WO 2014089152 A1 6/2014

OTHER PUBLICATIONS

European Search Report for Application No. EP 17173983.2 dated Dec. 7, 2017, 5 Pages.

*Primary Examiner* — Philip F Gabler
(74) *Attorney, Agent, or Firm* — McAndrews, Held & Malloy, Ltd.

(57) ABSTRACT

The present disclosure relates to a locking mechanism of an armrest assembly for a wheelchair, comprising: an elongated inner arm, an elongated outer profile, and a locking handle, wherein the locking handle is configured to pivot between proximal and distal pivot positions in which the locking handle is pivoted further away from the outer profile than in the proximal pivot position. The locking handle is configured to cause the locking structure to engage with the outer profile and the inner arm to axially interlock the outer profile with the inner arm, and wherein the locking handle is configured to move the locking structure from engagement (Continued)

with the outer profile and the inner arm to release the outer profile from axial interlocking with the inner arm when the outer profile is in the proximal position and the locking handle is moved from the distal pivot position towards the proximal pivot position.

15 Claims, 4 Drawing Sheets

(56) References Cited

U.S. PATENT DOCUMENTS

| | | | | |
|---|---|---|---|---|
| 8,132,861 | B2 * | 3/2012 | Cone | B60N 2/753 297/411.32 |
| 8,403,416 | B2 * | 3/2013 | Muck | B60N 2/767 297/411.32 |
| 8,919,883 | B2 * | 12/2014 | Hankins | A61G 5/125 297/411.32 |
| 9,272,645 | B2 * | 3/2016 | Bohner | B60N 2/767 |
| 9,321,381 | B2 * | 4/2016 | Itzinger | B64D 11/06 |
| 2009/0026826 | A1 | 1/2009 | Cebula | |

* cited by examiner

LOCKING MECHANISM OF AN ARMREST ASSEMBLY FOR A WHEELCHAIR AND A WHEELCHAIR COMPRISING THE SAME

CROSS-REFERENCE TO RELATED APPLICATIONS/INCORPORATION BY REFERENCE

The present application claims priority to European Patent Application No. 17173983.2, filed Jun. 1, 2017. The content of the above-identified application is hereby incorporated herein by reference in its entirety.

TECHNICAL FIELD

The present disclosure generally relates to wheelchairs. In particular, it relates to a locking mechanism of an armrest assembly for a wheelchair and to a wheelchair comprising an armrest assembly.

BACKGROUND

Wheelchairs are typically provided with armrests. This allows the user to not only rest their arms, but also to use an armrest for support in order to change position in the wheelchair. When utilising an armrest to change position, the user may need to grab the underside of the armrest. Armrest assemblies may therefore be designed so that they will not pivot upwards if grabbed from below. Additionally, users may want to transfer from the wheelchair to e.g. a chair or to a bed. This movement from the wheelchair is simplified if the user is able to move sideways from the wheelchair seat. The armrests are typically pivotable upwards, to allow the user to move out to the side. The armrests may therefore be made to be locked in their horizontal position to enable the user to grab the armrests for support, and to be released from this locking, to enable upwards pivoting of the armrests.

An example of an armrest for a wheelchair is disclosed in DE202006002357. In particular, a locking device for locking a pivotable armrest for a wheelchair is disclosed. A bearing body is provided with a locking surface configured to engage with an upper locking projection of a clamp-like locking body. A locking surface of the locking projection, facing downwards, abuts the free upwards directed locking surface. This prevents pivoting of the armrest upwards. The locking body can be pulled by hand against a spring force so that the locking projection and the locking surface no longer cooperate. The armrest may thereby be pivoted upwards.

The locking mechanism presented in DE202006002357 may be difficult to operate for users with reduced gripping capability/strength.

SUMMARY

In view of the above, a general object of the present disclosure is to provide a locking mechanism which solves or at least mitigates the problems of the prior art.

There is hence according to a first aspect of the present disclosure provided a locking mechanism of an armrest assembly for a wheelchair, comprising: an elongated inner arm having a pivot end portion configured to be pivotally attached to a seating system frame of the wheelchair, and a first elongated body extending from the pivot end portion, an elongated outer profile having a proximal outer profile end face provided with an axially extending channel configured to receive the first elongated body, and a distal outer profile end portion, the outer profile being configured to move linearly relative to the inner arm, between a proximal position relative to the pivot end portion and a distal position, a locking handle having a second elongated body configured to receive the outer profile, the locking handle having a proximal locking handle end portion relative to the pivot end portion of the inner arm and a distal locking handle end portion, the distal locking handle end portion being configured to be pivotally attached to the distal outer profile end portion thereby forming a first pivot connection, wherein the locking handle is configured to pivot about the first pivot connection relative to the outer profile and the inner arm, between a proximal pivot position and a distal pivot position in which the locking handle is pivoted further away from the outer profile than in the proximal pivot position, and a locking structure, wherein when the outer profile is in the proximal position and the locking handle is moved to the distal pivot position, the locking handle is configured to cause the locking structure to engage with the outer profile and the inner arm to axially interlock the outer profile with the inner arm, and wherein the locking handle is configured to move the locking structure from engagement with the outer profile and the inner arm to release the outer profile from axial interlocking with the inner arm when the outer profile is in the proximal position and the locking handle is moved from the distal pivot position towards the proximal pivot position.

The locking and releasing of the outer profile relative to the inner arm is hence provided by manoeuvring the locking handle between the proximal pivot position and the distal pivot position. The locking handle does not have to be biased towards the distal position to ensure a locked state of the locking mechanism, and manoeuvring thus only requires moving of the locking handle between the proximal pivot position and the distal pivot position. This manoeuvring may also be performed by users having a reduced gripping capability/strength. The manoeuvring of the locking handle furthermore only involves pivoting of the locking handle, which may be a more natural and simpler motion to carry out for a person with reduced gripping capability. Additionally, the manoeuvring of the locking handle may be carried out by either side of the hand.

Moreover, since the locking handle is generally not biased towards the distal pivot position, the user may set the locking handle in the proximal pivot position to release the outer profile from the inner arm and then without having to maintain the locking handle in this position, the user may pull the outer profile from the proximal position towards the distal position. In DE202006002357 a user is required to both pull the spring-biased locking body and pivot the armrest simultaneously. Such manoeuvring may be difficult for a user having reduced gripping capability/strength.

According to one embodiment the first elongated body has a proximal portion relative to the pivot end portion of the inner arm, which proximal portion has an outer surface provided with a first recess, and the outer profile has an outer surface provided with a second recess extending transversely with respect to a central axis of the outer profile, the second recess extending into the axially extending channel, wherein the locking structure is configured to extend into the first recess and into the second recess when the outer profile is in the proximal position and the locking handle is in the distal pivot position.

The locking structure can hence be moved in and out of the first recess and the second recess as the locking handle is moved towards the distal pivot position and the proximal pivot position, respectively. Relative movement between the outer profile and the inner arm may thus be prevented in case the locking structure is set by the locking handle to extend into the first recess and the second recess.

According to one embodiment the locking structure is configured to be moved concurrently with the locking handle when the locking handle is moved between the proximal pivot position and the distal pivot position.

According to one embodiment the outer profile has an outer surface provided with an axially extending groove, and the locking handle has a flexible locking tab, wherein the locking tab is configured to engage with the groove when the locking handle is in the proximal pivot position to retain the locking handle in the proximal pivot position.

According to one embodiment, the outer profile has an outer ramp surface arranged parallel with the groove, wherein the locking tab is configured to bear against the ramp surface when the locking handle is in the distal pivot position to retain the locking handle in the distal pivot position.

One embodiment comprises an elongated member, wherein the first elongated body has an axially extending slot, and the outer profile has a through-opening, wherein the elongated member is configured to extend through the through-opening into the slot, the slot in cooperation with the elongated member being configured to delimit the axial movement of the outer profile relative to the first elongated body.

The elongated member, or rod-like structure, may for example be a pin.

According to one embodiment the slot has a proximal axially delimiting wall and a distal axially delimiting wall, relative to the pivot end portion, defining the axial length of the slot, wherein the outer profile is in the distal position when the elongated member reaches the distal axially delimiting wall.

According to one embodiment the locking structure is configured to be interlocked with the locking handle.

According to one embodiment the locking structure is integrated with the locking handle.

According to one embodiment the locking handle has an axial length that is greater than the axial length of the inner arm, wherein the proximal locking handle end portion is configured to extend axially beyond the pivot end portion of the inner arm. This extension of the locking handle beyond the pivot end portion of the inner arm forms a long moment arm relative to the first pivot connection, which further facilitates for a user to manoeuvre the locking handle between the proximal pivot position and the distal pivot position.

According to one embodiment the locking handle comprises a polymer material.

According to one embodiment the locking structure is made of metal.

There is according to a second aspect of the present disclosure provided an armrest assembly for a wheelchair, comprising an armrest and a locking mechanism according to the first aspect presented herein, wherein the armrest is configured to be pivotally connected to the outer profile and to the locking handle via the first pivot connection.

One embodiment comprises a pivot arm configured to be pivotally connected to a seating system frame thereby forming a first seating system frame pivot connection, and to be pivotally connected to the first pivot connection, and to be connected to the armrest, so that movement of the outer profile between the proximal and the distal position causes pivoting of the pivot arm and the armrest about a pivot axis defined by the first seating system frame pivot connection.

There is according to a third aspect of the present disclosure provided a wheelchair comprising: a seating system frame, and an armrest assembly according to the second aspect, configured to be assembled with the seating system frame.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1A:
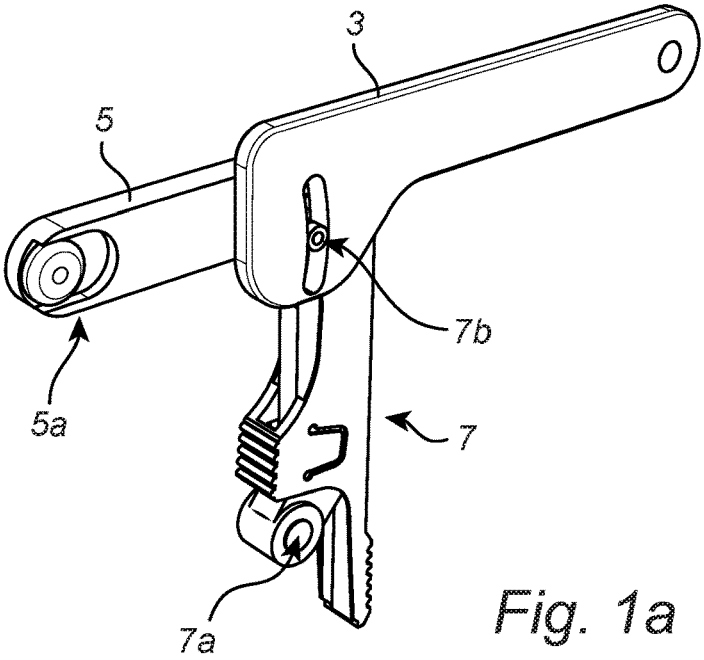
FIG. 1*a* is perspective view of a schematic example of an armrest assembly for a wheelchair in a default state.

FIG. 1*a* shows an example of an armrest assembly 1 for a wheelchair. The armrest assembly 1 comprises an armrest 3, a pivot arm 5, and a locking mechanism 7.

The pivot arm 5 is configured to be pivotally connected to a seating system frame of a wheelchair via a first seating system frame pivot connection 5*a*. The armrest 3 is configured to be rotationally locked relative to the pivot arm 5. The locking mechanism 7 is configured to be pivotally connected to a seating system frame of a wheelchair via a second seating system frame pivot connection 7*a*. The locking mechanism 7 is furthermore configured to be pivotally connected to the pivot arm 5 via a first pivot connection 7*b*.

The first pivot connection 7*b* is configured to be moved linearly relative to the second seating system frame pivot connection 7*a*, causing rotation of the pivot arm 5 about a first axis defined by the first seating system frame pivot connection 5*a*. This linear movement of the first pivot connection 7*b* also causes pivoting of the armrest 3 about the first axis and about a second axis defined by the second seating system frame pivot connection 7*a*.

Figure 1B:
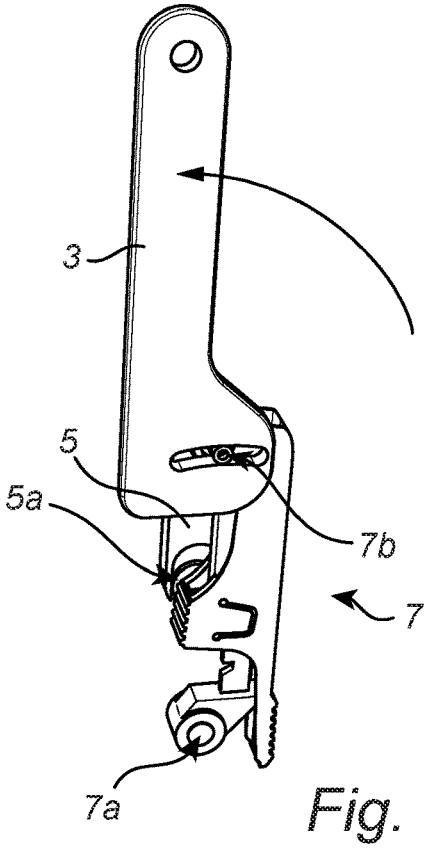
FIG. 1*b* is a perspective view of the armrest assembly shown in FIG. 1*a* in an upwards pivoted state.

In FIG. 1*a*, the armrest assembly 1 is in a default state in which the armrest 3 is in a horizontal position. The locking mechanism 7 is configured to maintain the armrest 3 in the horizontal position. Manoeuvring of the locking mechanism causes the locking mechanism to allow pivoting of the armrest 3. In FIG. 1*b* the armrest 3 is shown in a maximally upwardly pivoted position.

The armrest 3 is in this case in a substantially vertical position. The armrest 3 can be pivoted from the horizontal position by first setting the locking mechanism in a non-locking state which allows the armrest 3 to be pivoted The locking mechanism 7 will now be described in more detail with reference to FIGS. 2-4.

Figure 2:
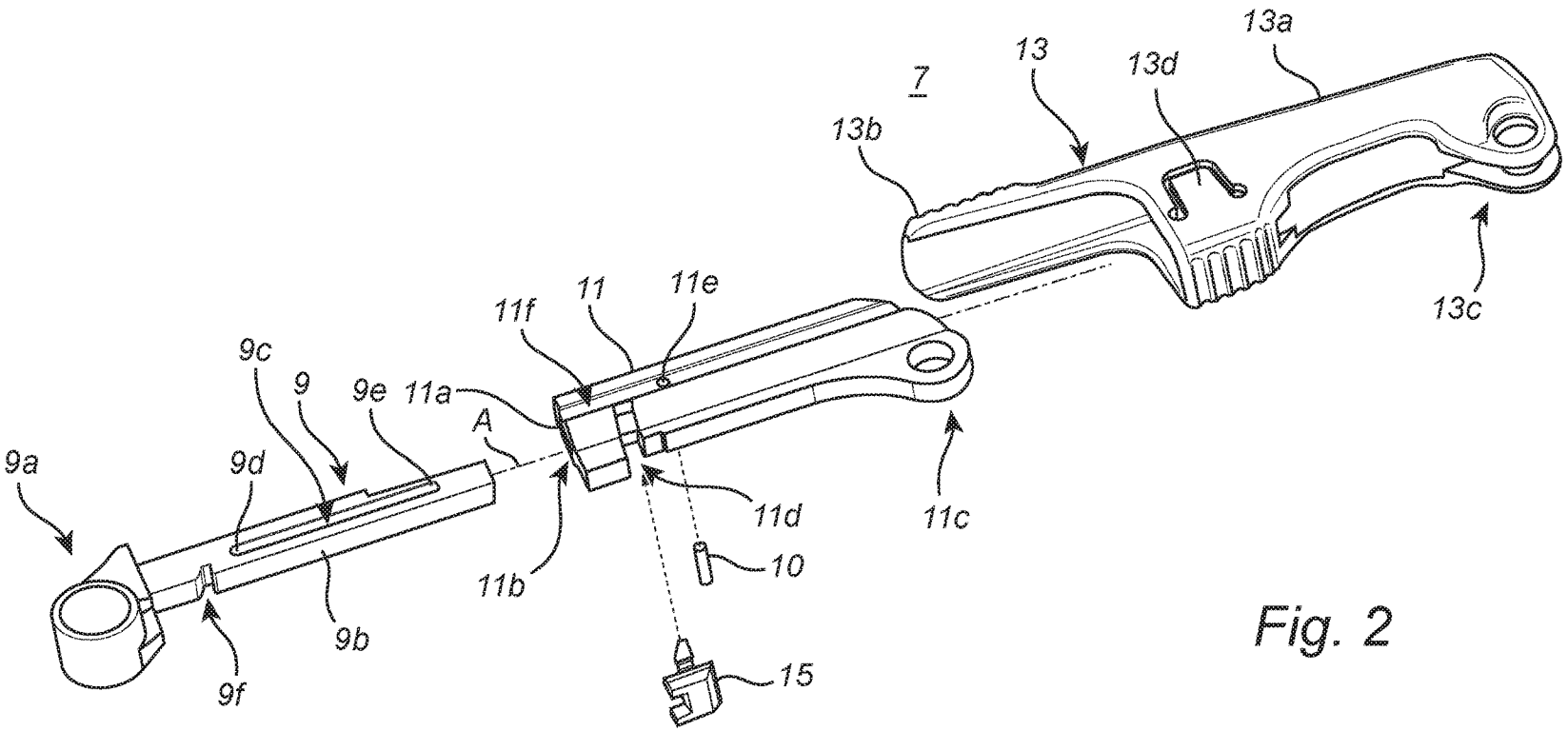
FIG. 2 is an exploded view of a locking mechanism of the armrest assembly in FIG. 1*a;*

FIG. 2 shows an exploded view of an example of the locking mechanism 7. The locking mechanism 7 comprises an inner arm 9, an elongated outer profile 11, a locking handle 13, and a locking structure 15.

The inner arm 9 has a pivot end portion 9*a* configured to be pivotally attached to a seating system frame of a wheelchair. The inner arm 9 has a first elongated body 9*b* extending from the pivot end portion 9*a*. The first elongated body 9*b* has an axially extending slot 9*c*, extending along the central axis A. The axially extending slot has a proximal axially delimiting wall 9*d* and a distal axially delimiting wall 9*e* which define the axial length of the slot 9*c*. The slot 9*c* extends through the first elongated body 9*b*, in a direction transverse to the central axis A.

The first elongated body 9*a* furthermore has a proximal portion relative to the pivot end portion 9*a* having an outer surface provided with a first recess 9*f*.

The outer profile 11 has a proximal outer profile end face 11*a* relative to the pivot end portion 9*a*, provided with an axially extending channel 11*b* and a distal outer profile end portion 11*c*. The channel 11*b* is configured to receive the first elongated body 9*b*. The outer profile 11 is configured to move linearly relative to the inner arm 9. When the first elongated body 9*b* is received maximally by the outer profile 11, the outer profile 11 is in a proximal position relative to the pivot end portion 9*a*. When the outer profile 11 has been moved maximally from the proximal position relative to the pivot end portion 9*a*, in an axial direction away from the pivot end portion 9*a*, the outer profile 11 is in a distal position relative to the pivot end portion 9*a*.

The outer profile 11 has a through-opening 11*e* configured to be aligned with the slot 9*c* of the first elongated body 9*b* when the first elongated body 9*b* is received by the outer profile 11. The locking mechanism 7 has an elongated member 10, configured to extend through the through-opening 11*e* and into the slot 9*c*. The elongated member 10 may be configured to extend through the slot 9*c* and out through a continuation of the through-opening 11*e*, extending through the outer profile 11 on an opposite side of the channel 11*b*. The elongated member 10 is in cooperation with the slot 9*c* configured to delimit the axial movement of the outer profile 11 relative to the inner arm 9. In particular, the elongated member 10 is configured to run in the slot 9*c* when the inner arm 9 is received by the outer profile 11. When the outer profile 11 is moved towards the distal position, the elongated member 10 runs in the slot 9*c* until it reaches the distal axially delimiting wall 9*e*, preventing the outer profile 11 to be moved further in the distal direction from the pivot end portion 9*a*.

The outer profile 11 furthermore has an outer surface provided with a second recess 11*d* extending transversely relative to the central axis A of the outer profile 11. The second recess 11*d* extends from the outer surface into the channel 11*b*. The first recess 9*f* of the first elongated body 9*b* and the second recess 11*d* are configured to be oriented in the same direction when the first elongated body 9*b* is received by the outer profile 11. In particular, the first recess 9*f* and the second recess 11*d* are configured to be axially aligned with each other when the outer profile 11 is in the proximal position relative to the pivot end portion 9*a*.

The outer profile 11 has an outer surface provided with an axially extending groove 11*f* extending from the proximal outer profile end face 11*a* to the distal outer profile end portion 11*c*.

The locking handle 13 has a second elongated body 13*a* configured to receive the outer profile 11. The locking handle 13 has a proximal locking handle end portion 13*b* relative to the pivot end portion 9*a* of the inner arm 9. The locking handle 13 has a distal locking handle end portion 13*c* configured to be pivotally attached to the distal outer profile end portion 11*c* thereby forming the first pivot connection 7*b* shown in FIG. 1*a*. The locking handle 13 is configured to pivot about the first pivot connection 7*b* relative to the outer profile and the inner arm 9. The locking handle 13 is configured to pivot between a proximal pivot position and a distal pivot position. In the distal pivot position, the locking handle is pivoted further away from the outer profile 11 than in the proximal pivot position.

The locking handle 13 has an axial length that is greater than the axial length of the inner arm 9. The proximal locking handle end portion 13*b* extends axially beyond the pivot end portion 9*a* of the inner arm 9.

The locking handle 13 has a flexible locking tab 13*d*. The locking tab 13*d* is configured to engage with the groove 11*f* of the outer profile 11 when the locking handle 13 is in the distal pivot position. The locking handle 13 is thereby retained in the distal pivot position.

The locking structure 15 may be a locking member which is separate from the locking handle 13 as in the example shown in FIG. 2. Alternatively, the locking structure may be integral with the locking handle.

The locking structure 15 may for example be made of a metal material such as steel. The locking handle 13 may be made of a polymer material, to make it flexible.

The locking structure 15 is according to the present example configured to be arranged in an interlocked manner with the locking handle 13 so that movement of the locking handle 13 between the proximal pivot position and the distal pivot position causes the locking structure 15 to move concurrently with the locking handle 13.

The locking structure 15 is configured to extend in between the first recess 9*f* and the second recess 11*d* when the first recess 9*f* and the second recess 11*d* are axially aligned. The first recess 9*f* and the second recess 11*d* are axially aligned when the outer profile 11 is in the proximal position. The locking structure 15 thus prevents the outer profile 11 to move axially relative to the inner arm 9, from the proximal position towards the distal position.

The operation of the locking mechanism 7 will now be described in more detail with reference to FIGS. 3*a*, 3*b* and FIG. 4.

Figure 3A:
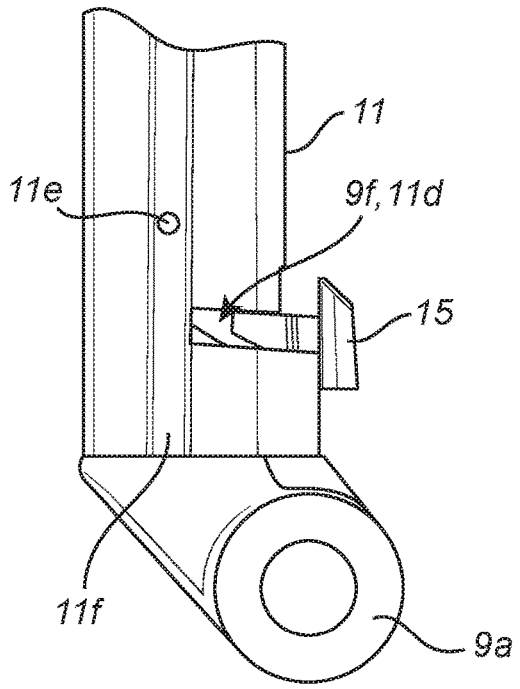
FIG. 3*a* is a detail of an inner arm and an outer profile receiving a first elongated body of the inner arm, with the locking handle removed for reasons of clarity.
Figure 3B:
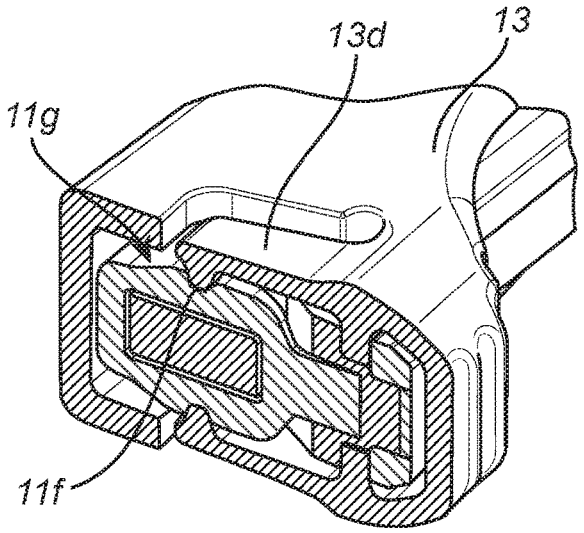
FIG. 3*b* shows a cross-section of the locking mechanism.
Figure 4:
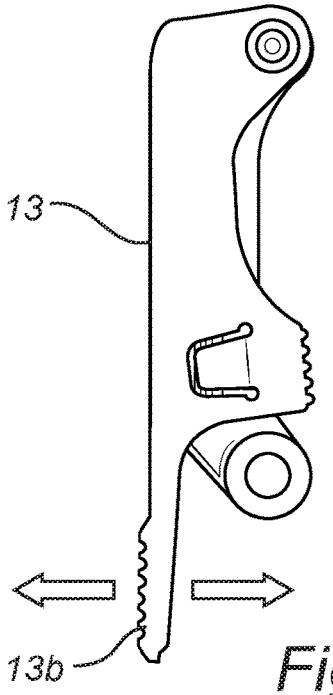
FIG. 4 shows a portion of the armrest assembly in FIG. 1*a;*.

FIG. 3*a* shows a portion of the locking mechanism 7 with the locking handle 13 removed and the outer profile 11 in the proximal position relative to the pivot end portion 9*a*. Here, although not shown, the locking handle 13 is in the proximal pivot direction, which corresponds to a movement in the direction shown by the right arrow in FIG. 4. The locking structure 15 is provided on an inner surface of the locking handle 13. Since the locking handle 13 is in the proximal pivot direction, the inner surface of the locking handle 13 provided with the locking structure 15 has been moved to the right in FIG. 4. The locking structure 15 is in this position disengaged from the first recess 9*f*. The outer profile 11 is thereby able to move from the proximal position towards the distal position. Furthermore, the locking tab 13*d* engages with the groove 11*f*, as shown in FIG. 3*b*. The locking handle 13 will thus remain in the proximal pivot position until a sufficient force is applied to the locking handle 13, causing the locking tab 13*d* to disengage from the groove 13*d*.

When the outer profile 11 is in the proximal position and the locking handle 13 is moved from the proximal pivot position towards the distal pivot position, the locking structure 15 is received by the axially aligned first recess 9*f* and second recess 11*d*. This engagement of the locking structure 15 with the first recess 9*f* and the second recess 11*d* prevents the outer profile 11 from being moved from the proximal position towards the distal position.

In particular, when a certain amount of force is applied to the proximal locking handle end portion 13*b* in a direction towards the distal pivot position, when the locking handle 13 is in the proximal pivot position, the locking handle 13 will move towards the distal pivot position. The locking tab 13*d*, which is flexible in the transverse direction to the central axis A, is then moved out from the groove 11*f*. Thus, if sufficient force is applied so that the locking handle 13 will pivot about the first pivot connection 7*b*, the locking tab 13*d* will flex out and disengage from the groove 11*f*. The locking tab 13 first reaches a top position of an outer ramp surface 11*g* of the outer profile 11, and is subsequently moved downwards along the ramp surface 11*g* as the locking handle 13 is moved towards the distal pivot position. Since the locking structure 15 is moved concurrently with the locking handle 13, the locking structure 15 is moved into the first recess 9*f* and the second recess 11*d*. When the locking handle 13 is in the distal pivot position, the locking tab 13 bears against the ramp surface 11*g*. The locking handle 13 will therefore remain in the distal pivot position until a certain amount of force is applied to the proximal locking handle end portion 13*b*, which allows the flexible locking tab 13*d* to move upwards along the ramp surface 11*g* and into the groove 11*f*. The locking handle 13 will thus obtain its proximal pivot position.

When the outer profile 11 is in the proximal position, the armrest 3 is in the horizontal position, i.e. the armrest assembly 1 is in the default state shown in FIG. 1*a*. When the outer profile 11 is in the distal position, the armrest 3 is in the maximally upwardly pivoted position shown in FIG. 1*b*. In this state of the armrest assembly 1, a user is able to move out to the side from the seat. The first seating system frame pivot connection 5*a* may be provided with e.g. washers such as spring washers and/or Teflon® washers to maintain the armrest in the upwards pivoted position.

Figure 5:
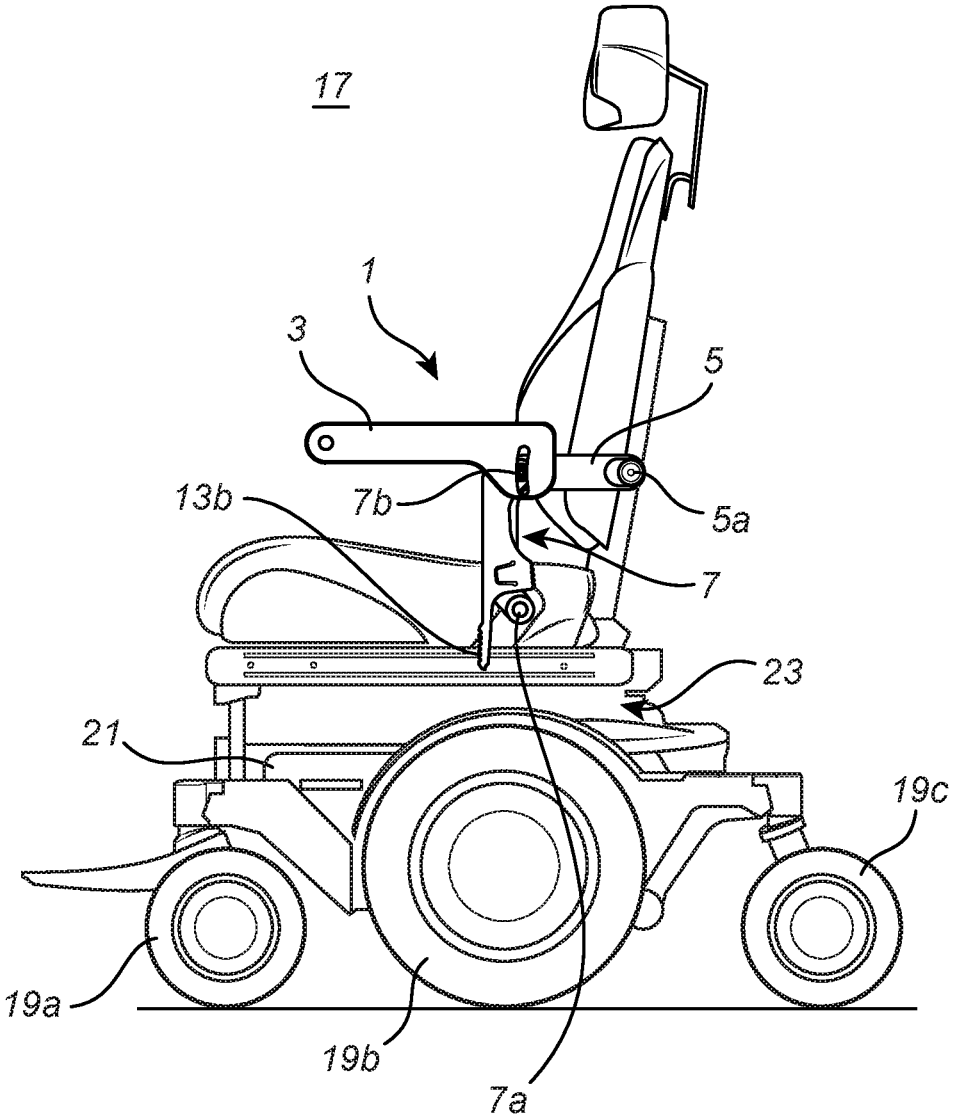
FIG. 5 schematically shows a wheelchair comprising the armrest assembly in FIG. 1*a.*

FIG. 5 shows an example of a wheelchair 17. The exemplified wheelchair is a powered wheelchair. The exemplified wheelchair 17 is a mid-wheel drive wheelchair, but could alternatively be a front-wheel drive wheelchair or a rear-wheel drive wheelchair. The wheelchair could also be a manual wheelchair.

The wheelchair 17 comprises a plurality of wheels 19*a*-19*c*, in the present example two front caster wheels 19*a*, two drive wheels 19*b* and two rear caster wheels 19*c*. The wheelchair 17 furthermore comprises a chassis frame 21 on which at least one battery, not shown, is mounted for driving the drive wheels 19*b*, the armrest assembly 1, including the locking mechanism 7, and a seating system frame 23. The seating system frame 23 comprises a seat frame onto which a seat cushion or an alternative seating system is mounted, and a back rest frame supporting a backrest cushion or an alternative seating system. An alternative seating system may for example be a pressure moulded seating adapted for a specific user body.

The armrest assembly 1 is mounted to the seating system frame 23. In particular, the first seating system frame pivot connection 5*a* is connected to the seating system frame 23 and the second seating system frame pivot connection 7*a*, i.e. the pivot end portion 9*a*, are connected to the seating system frame 23. The seating system frame 23 is mounted to the chassis frame 21. The armrest assemblies on both sides of the wheelchair 17 are armrest assemblies 1 as described herein.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A locking mechanism of an armrest assembly for a wheelchair, comprising:

an elongated inner arm having a pivot end portion configured to be pivotally attached to a seating system frame of the wheelchair, and a first elongated body extending from the pivot end portion, an elongated outer profile having a proximal outer profile end face provided with an axially extending channel configured to receive the first elongated body, and a distal outer profile end portion, the outer profile being configured to move linearly relative to the inner arm, between a proximal position relative to the pivot end portion and a distal position, a locking handle having a second elongated body configured to receive the outer profile, the locking handle having a proximal locking handle end portion relative to the pivot end portion of the inner arm and a distal locking handle end portion, the distal locking handle end portion being configured to be pivotally attached to the distal outer profile end portion thereby forming a first pivot connection, wherein the locking handle is configured to pivot about the first pivot connection relative to the outer profile and the inner arm, between a proximal pivot position and a distal pivot position in which the locking handle is pivoted further away from the outer profile than in the proximal pivot position, and a locking structure, wherein when the outer profile is in the proximal position and the locking handle is moved to the distal pivot position, the locking handle is configured to cause the locking structure to engage with the outer profile and the inner arm to axially interlock the outer profile with the inner arm, and wherein the locking handle is configured to move the locking structure from engagement with the outer profile and the inner arm to release the outer profile from axial interlocking with the inner arm when the outer profile is in the proximal position and the locking handle is moved from the distal pivot position towards the proximal pivot position.

2. The locking mechanism of claim 1, wherein the first elongated body has a proximal portion relative to the pivot end portion of the inner arm, which proximal portion has an outer surface provided with a first recess, and the outer profile has an outer surface provided with a second recess extending transversely with respect to a central axis of the outer profile, the second recess extending into the axially extending channel, wherein the locking structure is configured to extend into the first recess and into the second recess when the outer profile is in the proximal position and the locking handle is in the distal pivot position.

3. The locking mechanism of claim 1, wherein the locking structure is configured to be moved concurrently with the locking handle when the locking handle is moved between the proximal pivot position and the distal pivot position.

4. The locking mechanism of claim 1, wherein the outer profile has an outer surface provided with an axially extending groove, and the locking handle has a flexible locking tab, wherein the locking tab is configured to engage with the groove when the locking handle is in the proximal distal pivot position to retain the locking handle in the proximal pivot position.

5. The locking mechanism of claim 4, wherein the outer profile has an outer ramp surface arranged parallel with the groove, wherein the locking tab is configured to bear against the ramp surface when the locking handle is in the distal pivot position to retain the locking handle in the distal pivot position.

6. The locking mechanism of claim 1, comprising an elongated member, wherein the first elongated body has an axially extending slot, and the outer profile has a through-opening, wherein the elongated member is configured to extend through the through-opening into the slot, the slot in cooperation with the elongated member being configured to delimit the axial movement of the outer profile relative to the first elongated body.

7. The locking mechanism of claim 6, wherein the slot has a proximal axially delimiting wall and a distal axially delimiting wall, relative to the pivot end portion, defining the axial length of the slot, wherein the outer profile is in the distal position when the elongated member reaches the distal axially delimiting wall.

8. The locking mechanism of claim 1, wherein the locking structure is configured to be interlocked with the locking handle.

9. The locking mechanism of claim 1, wherein the locking structure is integrated with the locking handle.

10. The locking mechanism of claim 1, wherein the locking handle has an axial length that is greater than the axial length of the inner arm, wherein the proximal locking handle end portion is configured to extend axially beyond the pivot end portion of the inner arm.

11. The locking mechanism of claim 1, wherein the locking handle comprises a polymer material.

12. The locking mechanism of claim 1, wherein the locking structure is made of metal.

13. An armrest assembly for a wheelchair, comprising:

an armrest, and a locking mechanism comprising:

an elongated inner arm having a pivot end portion configured to be pivotally attached to a seating system frame of the wheelchair, and a first elongated body extending from the pivot end portion, an elongated outer profile having a proximal outer profile end face provided with an axially extending channel configured to receive the first elongated body, and a distal outer profile end portion, the outer profile being configured to move linearly relative to the inner arm, between a proximal position relative to the pivot end portion and a distal position, a locking handle having a second elongated body configured to receive the outer profile, the locking handle having a proximal locking handle end portion relative to the pivot end portion of the inner arm and a distal locking handle end portion, the distal locking handle end portion being configured to be pivotally attached to the distal outer profile end portion thereby forming a first pivot connection, wherein the locking handle is configured to pivot about the first pivot connection relative to the outer profile and the inner arm, between a proximal pivot position and a distal pivot position in which the locking handle is pivoted further away from the outer profile than in the proximal pivot position, and a locking structure, wherein when the outer profile is in the proximal position and the locking handle is moved to the distal pivot position, the locking handle is configured to cause the locking structure to engage with the outer profile and the inner arm to axially interlock the outer profile with the inner arm, and wherein the locking handle is configured to move the locking structure from engagement with the outer profile and the inner arm to release the outer profile from axial interlocking with the inner arm when the outer profile is in the proximal position and the locking handle is moved from the distal pivot position towards the proximal pivot position, wherein the armrest is configured to be pivotally connected to the outer profile and to the locking handle via the first pivot connection.

14. The armrest assembly of claim 13, comprising a pivot arm configured to be pivotally connected to a seating system frame thereby forming a first seating system frame pivot connection, to be pivotally connected to the first pivot connection, and to be connected to the armrest, so that movement of the outer profile between the proximal position and the distal position causes pivoting of the pivot arm and the armrest about a pivot axis defined by the first seating system frame pivot connection.

15. A wheelchair comprising:

a seating system frame, and an armrest assembly configured to be assembled with the seating system frame, the armrest assembly comprising:

an armrest, and a locking mechanism comprising:

an elongated inner arm having a pivot end portion configured to be pivotally attached to a seating system frame of the wheelchair, and a first elongated body extending from the pivot end portion, an elongated outer profile having a proximal outer profile end face provided with an axially extending channel configured to receive the first elongated body, and a distal outer profile end portion, the outer profile being configured to move linearly relative to the inner arm, between a proximal position relative to the pivot end portion and a distal position, a locking handle having a second elongated body configured to receive the outer profile, the locking handle having a proximal locking handle end portion relative to the pivot end portion of the inner arm and a distal locking handle end portion, the distal locking handle end portion being configured to be pivotally attached to the distal outer profile end portion thereby forming a first pivot connection, wherein the locking handle is configured to pivot about the first pivot connection relative to the outer profile and the inner arm, between a proximal pivot position and a distal pivot position in which the locking handle is pivoted further away from the outer profile than in the proximal pivot position, and a locking structure, wherein when the outer profile is in the proximal position and the locking handle is moved to the distal pivot position, the locking handle is configured to cause the locking structure to engage with the outer profile and the inner arm to axially interlock the outer profile with the inner arm, and wherein the locking handle is configured to move the locking structure from engagement with the outer profile and the inner arm to release the outer profile from axial interlocking with the inner arm when the outer profile is in the proximal position and the locking handle is moved from the distal pivot position towards the proximal pivot position, wherein the armrest is configured to be pivotally connected to the outer profile and to the locking handle via the first pivot connection.

* * * * *